US010502051B2

(12) United States Patent
Latrille et al.

(10) Patent No.: US 10,502,051 B2
(45) Date of Patent: Dec. 10, 2019

(54) METHOD AND APPARATUS FOR DOWNLOADING WHILE DRILLING DATA

(75) Inventors: Frederic Latrille, Houston, TX (US); Shyam B. Mehta, Missouri City, TX (US); Michael A. Montgomery, Cedar Park, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 2083 days.

(21) Appl. No.: 11/616,750

(22) Filed: Dec. 27, 2006

(65) Prior Publication Data

US 2008/0158004 A1 Jul. 3, 2008

(51) Int. Cl.
*E21B 47/12* (2012.01)

(52) U.S. Cl.
CPC ..... *E21B 47/122* (2013.01)

(58) Field of Classification Search
CPC ..... E21B 47/122
USPC ..... 340/855.3–855.5; 166/254.2, 382; 702/6
See application file for complete search history.

(56) References Cited

U.S. PATENT DOCUMENTS

| | | | | |
|---|---|---|---|---|
| 4,736,204 | A | 4/1988 | Davison | |
| 5,419,405 | A * | 5/1995 | Patton | 175/27 |
| 5,521,592 | A | 5/1996 | Veneruso et al. | |
| 6,252,518 | B1 * | 6/2001 | Laborde | 340/855.4 |
| 6,768,700 | B2 | 7/2004 | Schlumberger | |
| 6,831,571 | B2 | 12/2004 | Bartel | |
| 7,040,415 | B2 | 5/2006 | Schlumberger | |
| 7,145,472 | B2 | 12/2006 | Lilly et al. | |
| 7,490,428 | B2 * | 2/2009 | Morys | 340/853.1 |
| 7,730,967 | B2 * | 6/2010 | Ballantyne et al. | 175/40 |
| 7,999,695 | B2 * | 8/2011 | Rodney et al. | 340/855.5 |
| 2001/0029780 | A1 * | 10/2001 | Bartel | 73/152.03 |
| 2005/0194182 | A1 * | 9/2005 | Rodney et al. | 175/24 |
| 2007/0030167 | A1 * | 2/2007 | Li et al. | 340/855.1 |
| 2008/0156485 | A1 * | 7/2008 | Phillips et al. | 166/254.2 |
| 2010/0271233 | A1 * | 10/2010 | Li et al. | 340/854.9 |

FOREIGN PATENT DOCUMENTS

| | | | |
|---|---|---|---|
| GB | 2372521 | A | 8/2002 |
| GB | 2407334 | A | 4/2005 |
| WO | 2003101047 | A2 | 12/2003 |

OTHER PUBLICATIONS

Search Report for Application No. GB0712168.4 dated Oct. 26, 2007.
Examination Report for Application No. GB0712168.4 dated Oct. 26, 2007.
Examination Report for Application No. GB0712168.4 dated Mar. 25, 2009.

* cited by examiner

*Primary Examiner* — Albert K Wong

(57) ABSTRACT

A method for transferring data between a surface computer and a downhole assembly may include connecting the surface computer to a single data port in the downhole assembly, transferring data between the surface computer and a first while drilling tool through the data port, and transferring data between the surface computer and a second while drilling tool through the data port.

10 Claims, 3 Drawing Sheets

METHOD AND APPARATUS FOR DOWNLOADING WHILE DRILLING DATA

BACKGROUND OF THE INVENTION

Field of the Invention

The invention relates generally to the field of transferring data to or from a while drilling tool in a downhole drilling assembly. In particular, the invention relates to collecting data from while drilling tools or sending data to while drilling tools that are interconnected by a high-speed data bus.

Background Art

Wells are drilled into the Earth to recover deposits of hydrocarbons, such as oil and natural gas, as well as other minerals. The drilling process is complicated and often requires a drilling assembly that include numerous tools and sensors with a drill bit. For example, a typical drilling assembly may include MWD, LWD, and Rotary Steerable tools that may include various sensors, as is known in the art. The data collected by while drilling sensors may be stored in memories in the tools for later retrieval. Each tool may have a data port which can be used to individually retrieve data from each tool.

SUMMARY OF THE INVENTION

In one aspect, the invention may relate to a method for transferring data between a surface computer and a downhole assembly that includes connecting the surface computer to a single data port in the downhole assembly, transferring data between the surface computer and a first while drilling tool through the data port, and transferring data between the surface computer and a second while drilling tool through the data port.

In another aspect, the invention may relate to an assembly for retrieving while drilling data that includes a downhole assembly having a data port, a first while drilling tool, and a second while drilling tool, a high-speed downhole data bus connecting at least the data port, the first while drilling tool, and the second while drilling tool, and a surface computer connected to the data port.

In another aspect, the invention may relate to a method of retrieving while drilling data that includes deploying a wireline device into a wellbore, connecting the wireline to a port on a while drilling tool in a drilling assembly, downloading while drilling data collected by a first while drilling tool, and downloading while drilling data collected by a second while drilling tool.

In another aspect, the invention may relate to a method of retrieving while drilling data that includes deploying a fishing device into a wellbore, fishing one or more memory devices located in the drilling assembly, and retrieving the while drilling data from the one or more memory devices at surface.

Other aspects and advantages of the invention will be apparent from the following description and the appended claims.

DETAILED DESCRIPTION

Figure 1:
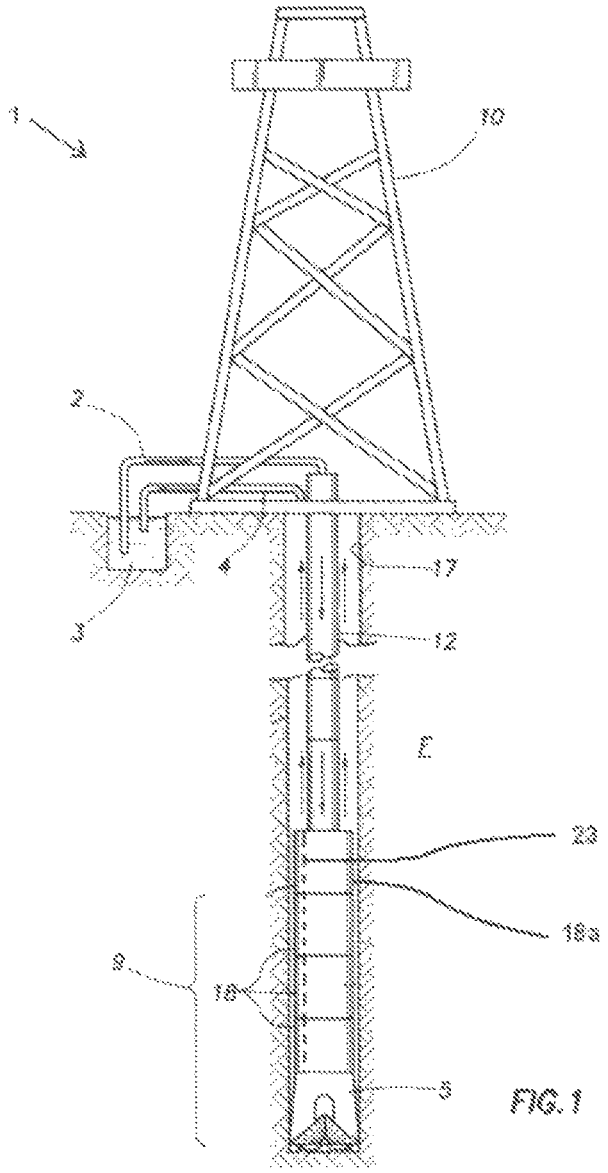
FIG. 1 shows a example of a typical drilling system.

FIG. 1 shows a typical drilling system 1 that includes a drilling rig 10 that is used to drill a borehole 17 by advancing a drill bit 5 through a formation F in the Earth. The drill bit 5 is located at the lower end of a drill string 12 that is rotated from the surface. Drilling fluid, called "mud," is pumped through a stand pipe 2, down through the drill string 12, and through nozzles in the drill bit 5. The mud serves to lubricate and cool the drill bit 5, as well as to carry drill cuttings to the surface as the mud flows upwardly through the annulus between the drill string 12 and the borehole wall 17. The mud may be returned to the mud pit through pipe 4.

Drilling is generally performed using a drilling assembly 9, sometimes called a "bottom hole assembly," or BHA, at the lower end of the drill string 12. The drilling assembly 9 includes the drill bit 5 and one or more while drilling tools 18. The while drilling tools 18 may include MWD and LWD tools, as is known in the art. MWD and LWD tools measure and collect data about the drilling process and the formation F through which the drilling assembly 9 is drilling. As is known in the art, a portion of the data collected by MWD and LWD tools may be telemetered to the surface during the drilling operation. One example of a telemetry method is mud-pulse telemetry, which uses modulated pressure pulses to transmit data to the surface.

Another example of a telemetry system is called "wired drill pipe." In general, wired drill pipe refers to a drill pipe that includes a conductor or fiber optic device so that data from the drilling assembly may be transmitted to the surface through the wired drill pipe. In such a system, the drill string 12 shown in FIG. 1, which is made up of interconnected drill pipe segments, would include a wire or conductor such that signals may be passed from the drilling assembly 9 to the surface. The data transfer rate that may be achieved using wired drill pipe is significantly higher than that of other forms of telemetry, such as mud-pulse telemetry.

Because of the higher data transfer rated that may be achieved using wired drill pipes, the data transfer bus 23 in the drilling assembly 9 may be enhanced so that it is also capable of high-speed data communication. A conventional downhole bus may be capable of communications at a rate of about 4.8 Kbps. Because of the advent of wired drill pipe, a high-speed data bus 23 may be capable of data transfer rated of 100 Kbps, 1 Mbps, or higher. Such a high-speed bus 23 would enable high-speed communication between the individual tools 18 and components in the drilling assembly. For example, one of the tools 18 may be a wired drill pipe telemetry tool 18*a*. The high-speed data bus 23 may enable high-speed communications between the wired drill pipe telemetry tool 18*a* and the other tools 18 in the drilling assembly. It is also noted that the high speed data bus 23 may also be used in combination with conventional mud pulse telemetry or with other telemetry devices that are known in the art.

Figure 2:
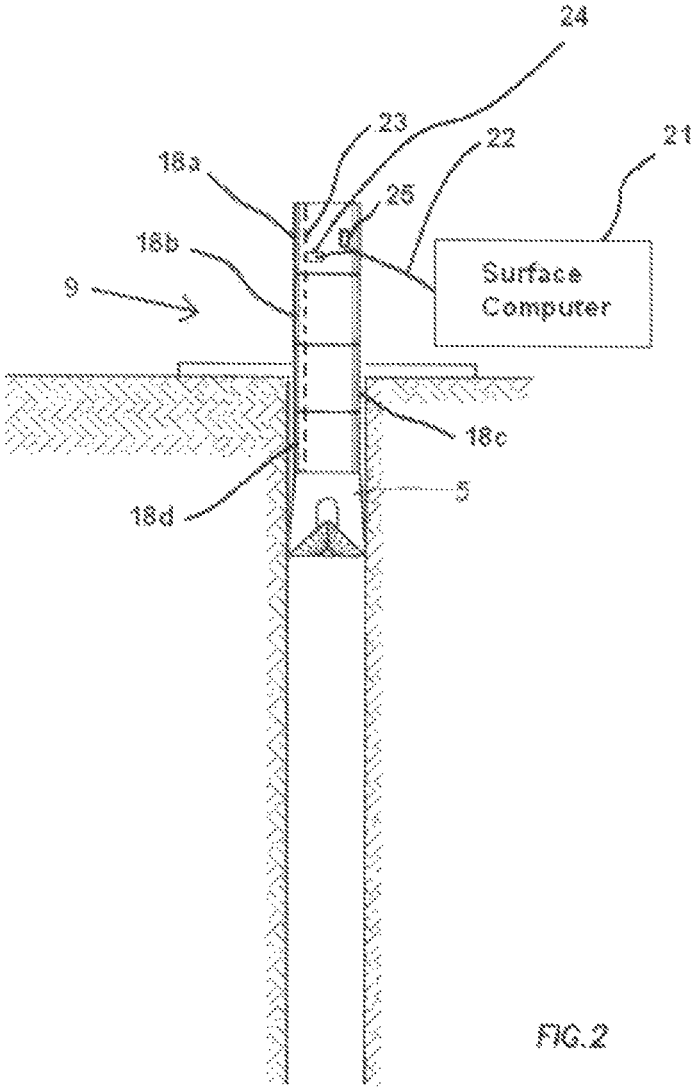
FIG. 2 shows a schematic of an example system for downloading while drilling data.

As shown in FIG. 2, upon retrieval of the drilling assembly 9, a surface computer 21 may be connected to the tools 18*a*, 18*b*, 18*c*, 18*d* in the drilling assembly 9. The surface computer 21 may be connected to the port 24 using data cable 22. In another example, the surface computer 21 may connected to a tool 18 via a wireless connection.

The data from each tool 18 may be downloaded to the computer 21. Even when a wired drill pipe system is used, the while drilling tools 18 may not transmit all of the collected data during the drilling process. In addition, the data may be downloaded as a check to be sure that data telemetered during the drilling process was correctly received. In another example, a wired drill pipe system may fail during drilling, and the while drilling data may be retrieved upon the retrieval to the surface of the drilling assembly 9. In addition, a wired drill pipe may incur the failure of a repeater. In such a case, once the failed repeater reaches the surface during a trip out, communications with the drilling assembly 9 may be restored, and while drilling data from multiple tools may be downloaded to a surface computer 21 during the remainder of the trip out. Similarly, data can be transferred from the computer 21 to each tool 18. Any type of data may be transferred to the tool, but such data does include a command or a configuration instruction.

Thus, upon retrieval, a surface computer 21 may be connected to communications port 24 in a single tool 18*a* in the drilling assembly 9. For example, the tool 18*a* may be a wired drill pipe telemetry tool. In another example, the tool 18*a* may be a tool specifically designed for downhole communications. In yet another example, the tool 18*a* may be a tool with a separate purpose, but that includes a port 24 for downloading downhole data. The port 24 may be a connector for connecting a data cable 22, or the port 24 may be a wireless port. The data from all of the tools 18*a*, 18*b*, 18*c*, 18*d* may be transferred through the high-speed data bus 23 to the data port 24 and to the surface computer 21. In this manner, the data from a plurality of while drilling tools 18*a*, 18*b*, 18*c*, 18*d* may be downloaded using only one connection 24. Because of the high-speed data bus 23, such a method would be able to download the data from multiple tools 18*a*, 18*b*, 18*c*, 18*d* faster than the data could be downloaded by connecting the computer 21 to each while drilling tool 18*a*, 18*b*, 18*c*, 18*d* individually, as is conventionally done. This method is valid regardless of whether if one or several tools in the drilling assembly also has a conventional individual data port or not.

The port 24 may be any connector that enables the connection of a surface computer 21 to the tool 18*a* so that while drilling data may be downloaded. For example, the port may be a USB connection or other well known connection. In another example, the port 24 may be a wet connect that enables a quick connection to the port 24 once the tool is retrieved or by a wireline or other device that may be sent into the borehole 17 to connect with the port 24. The port 24 may be a wireless port.

In one example, the connection to the port 24 in tool 18*a* may enable the configuration of the other while drilling tools 18*b*, 18*c*, 18*d* through the high-speed data bus 23. The drilling data may be downloaded, and the surface computer 21 may be used to communicate with one or more of the other tools 18*b*, 18*c*, 18*d* to run diagnostics and other tests, as well as configure the tools for future deployment in the well.

In another example, the tool 18*a* may be a memory tool or memory sub or a memory device located in any tool in the drilling assembly 9. In such a case, one or more of the other downhole tools 18*b*, 18*c*, 18*d* may transmit while drilling data to the memory tool 18*a* for storage. The transmission to the memory tool 18*a* may occur during the drilling process, as the data are collected. In another example, the data may be transmitted from the while drilling tools 18*b*, 18*c*, 18*d* that collect the data to a memory tool 18*a* during a trip out of the well. Upon removal of the drilling assembly 9, a surface computer 21 may be connected to the data port 24 so that the data from the while drilling tools 18*b*, 18*c*, 18*d* may be downloaded from the memory in the memory tool 18*a*, which may provide a higher rate of download if the speed of the data port 24 exceeds the speed of the high-speed data bus 23. Although provided only as an example, a USB data port may be capable of transfer rates of 480 Mbps, while a high-speed data bus 23 might be limited to a transfer rate of 1 Mbps.

Figure 3:
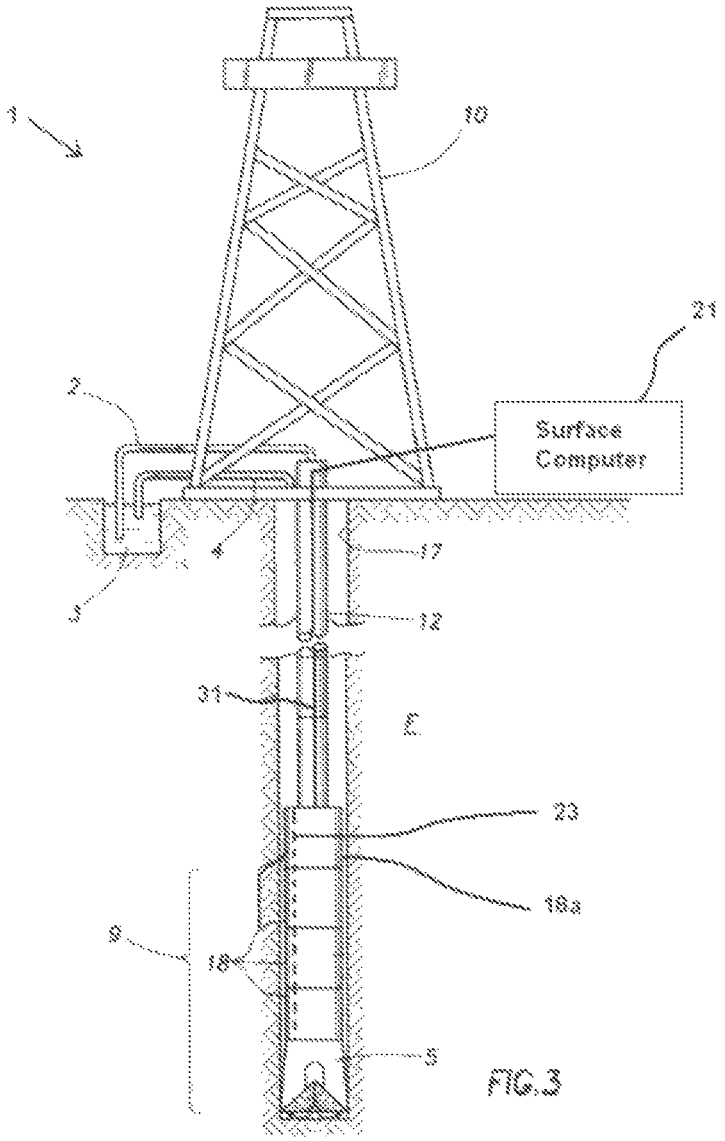
FIG. 3 shows a schematic of an example system for downloading while drilling data.

FIG. 3 shows another example, where a wireline 31 or other cable is run from the surface to the while drilling tool 18*a* in the drilling assembly 9. The wireline 31 may be used to connect to a data port in the tool 18*a* so that while drilling data may be downloaded to the surface computer 21 while the drilling assembly is still in the borehole 17. This may be advantageous because it enables a large amount of data to be downloaded during the time when the drilling assembly 9 is being tripped to the surface. In one other example, the drilling assembly may become stuck, and the wireline 31 connection to the surface computer 21 may enable the transfer of data from multiple while drilling tools 18*a*, 18*b*, 19*c*, 18*d*, when the entire drilling assembly may be lost. In such a case, the while drilling data may not be lost with the tools. In one other example, at least one memory device may become full and the wireline 31 connection to the surface computer 21 may enable the transfer of data from one or more memory devices, thereby creating free memory that enables the while drilling tool to acquire further data.

In another example where the drilling assembly 9 becomes stuck, instead of a wireline, a fishing tool (also represented as 31) may be lowered into the borehole 17 and attached to the top while drilling tool 18*a*. The tool 18*a*, which may store the while drilling data for multiple while drilling tools 18*b*, 18*c*, 18*d*, may be retrieved to the surface so that the while drilling data may be downloaded to a surface computer 21. It may also be possible to fish a memory device from the tool 18*a*. In one example, a plurality of memory devices may be retrieved from the drilling assembly.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for transferring data between a surface computer and a downhole assembly comprising a first while drilling tool and a second while drilling tool, the method comprising:

connecting the first and second while drilling tools to a data port in the downhole assembly via a high-speed tool data bus;

tripping the first while drilling tool to the surface;

connecting the surface computer to the data port;

after tripping the first while drilling tool to the surface, transferring data between the surface computer and the first while drilling tool through the data port when the first while drilling tool is at the surface; and after tripping the first while drilling tool to the surface, transferring data between the surface computer and the second while drilling tool through the data port when the first while drilling tool is at the surface.

2. The method of claim 1, wherein transferring data between the surface computer and the first while drilling tool and transferring the data and the second while drilling tool comprises transmitting the data via a wireless connection.

3. The method of claim 1, wherein transferring data between the surface computer and the first while drilling tool and transferring the data and the second while drilling tool comprises transmitting the data via a wired connection to the surface computer.

4. The method of claim 1, wherein transferring data between the surface computer and the first while drilling tool and transferring data between the surface computer and the second while drilling tool comprises transmitting the data via a wired drill pipe system.

5. The method of claim 1, wherein connecting the surface computer to the data port comprises:

connecting an end of a wireline to the single data port.

6. The method of claim 1, wherein the connection between the surface computer and the data port is a wireless connection.

7. The method of claim 1, further comprising storing data collected by the first while drilling tool and the second while drilling tool in a memory device included in the drilling assembly.

8. The method of claim 1, wherein transferring data between the surface computer and the first while drilling tool and transferring data between the surface computer and the second while drilling tool comprises downloading while drilling data collected by the first while drilling tool and downloading while drilling data collected by the second while drilling tool.

9. The method of claim 1, further comprising telemetering at least a portion of the data from the first while drilling tool to the surface computer before tripping the first while drilling tool to the surface.

10. The method of claim 1, wherein transferring data between the surface computer and the second while drilling tool includes transferring data from the second while drilling computer to the first while drilling tool while tripping the first while drilling tool to the surface.

* * * * *